United States Patent [19]
Itri et al.

[11] Patent Number: 4,465,262
[45] Date of Patent: Aug. 14, 1984

[54] PORTABLE EXPANDABLE BARRIER

[76] Inventors: Gary Itri; Mary Riley, both of 6023 Buffalo Ave., Van Nuys, Calif. 91401

[21] Appl. No.: 398,679

[22] Filed: Jul. 15, 1982

[51] Int. Cl.[3] ..... E04H 17/16
[52] U.S. Cl. ..... 256/24; 256/23; 256/73; 160/374; 49/55
[58] Field of Search ..... 160/225, 226, 227, 374; 49/55, 57; 256/24, 1, 73, 23

[56] References Cited

U.S. PATENT DOCUMENTS

| | | | |
|---|---|---|---|
| Re. 17,911 | 12/1930 | Rexinger | 160/225 X |
| Re. 19,617 | 6/1935 | Van Dresser | 160/225 X |
| 247,606 | 9/1881 | Brown | 160/374 |
| 1,952,055 | 3/1934 | Barcham | 160/374 X |
| 3,097,014 | 7/1963 | Francis | 160/374 X |

FOREIGN PATENT DOCUMENTS

| | | | |
|---|---|---|---|
| 1356059 | 6/1974 | United Kingdom | 256/24 |
| 2063956 | 6/1981 | United Kingdom | 256/24 |

*Primary Examiner*—Andrew V. Kundrat
*Attorney, Agent, or Firm*—John J. Posta, Jr.

[57] ABSTRACT

An improved portable expandable barrier is provided which comprises a pair of fences slideably interconnected and releasably held in a desired orientation by locking means such as lock set cylinders. Preferably, one or both fences include telescoping sections releasably locked together to facilitate expansion of the barrier. In one embodiment the fences include elongated bars over which cylinders are slideably secured.

Pins or screws pass through the body of the bars of each fence and into engagement with the cylinder to prevent separation of the fences. The barrier can also include one or more collapsible posts fitted with expandable internal bladders and disposed adjacent pairs of the fences. The fence perimeters are provided with means for releasably locking the fences to the posts or other structures. Such means may be adjustable suction caps, preferably protected by overlaying adjustable bell covers locked in place. Such means can also include pins receivable within openings disposed in a door or window frame. The barrier is inexpensive, reusable, fully adjustable and easy to install, use and remove.

5 Claims, 6 Drawing Figures

PORTABLE EXPANDABLE BARRIER

BACKGROUND OF THE INVENTION

1. Field of the Invention

The present invention generally relates to protective means and more particularly to an improved portable expandable barrier.

2. Prior Art

Conventional temporary barriers in the form of marker cones, so called wooden saw horses, are used for temporary traffic control in outdoor situations and have little deterring capability, etc. Collapsible hinged gates for doorways, and the like are employed indoors and usually are either expensive, bulky, and/or difficult to assemble, disassemble and store. Many require the installation of hooks, hinges and other sharp and potentially dangerous and unsightly accessories in door frames, window frames and the like. If and when the barrier is removed, the accessories become noticeable and must also be removed and the frame repaired.

Accordingly, it would be desirable to be able to provide a temporary portable expandable barrier which is inexpensive, reusable, easily assembled, disassembled and stored in a minimum space, require no unsightly accessories and is effective both indoors and outdoors to block access to a desired area.

SUMMARY OF THE INVENTION

The improved portable expandable barrier of the present invention satisfies all the foregoing needs. The barrier is substantially as set forth above. Thus, it comprises two major components, a pair of fences with bars, slats or the like. The fences are slideably interconnected so that the barrier can be expanded for example, horizontally. For this purpose, slideable cylinders can be disposed over bars in the fences and pins can pass from the bars of each fence to engage the cylinders of the other fence. Preferably, one or both fences also comprises a pair of telescoping sections releasably locked together so that the barrier can be expanded, for example, vertically as well as horizontally. If desired "F" configured fittings can be provided at the corners of each fence to allow ease of assembly. Further, if the fitting is made of metal and the bars made of wood, the fitting would make the fence more rigid and prevent marring or damage during movement, storage, etc.

The barrier further includes means at the perimeter thereof which releasably lock the barrier to a structure such as a door frame, window frame, a post, etc. Such mean may be spaced suction cups preferably protected by adjustable bell covers lockable in place over the cups. Such locking means may also be spaced pins receivable in openings in the structure to which the barrier is to be temporarily connected.

The barrier can include one or more posts, each comprising one or more collapsible walls moveable into operative position by an expandable bladder disposed in the central space in the post. The posts are readily erected, collapsed and stored. Further features as set forth in the following details description and accompanying drawings.

DRAWINGS

DETAILED DESCRIPTION OF THE PREFERRED EMBODIMENT

Figures 1, 2, 3, 4:
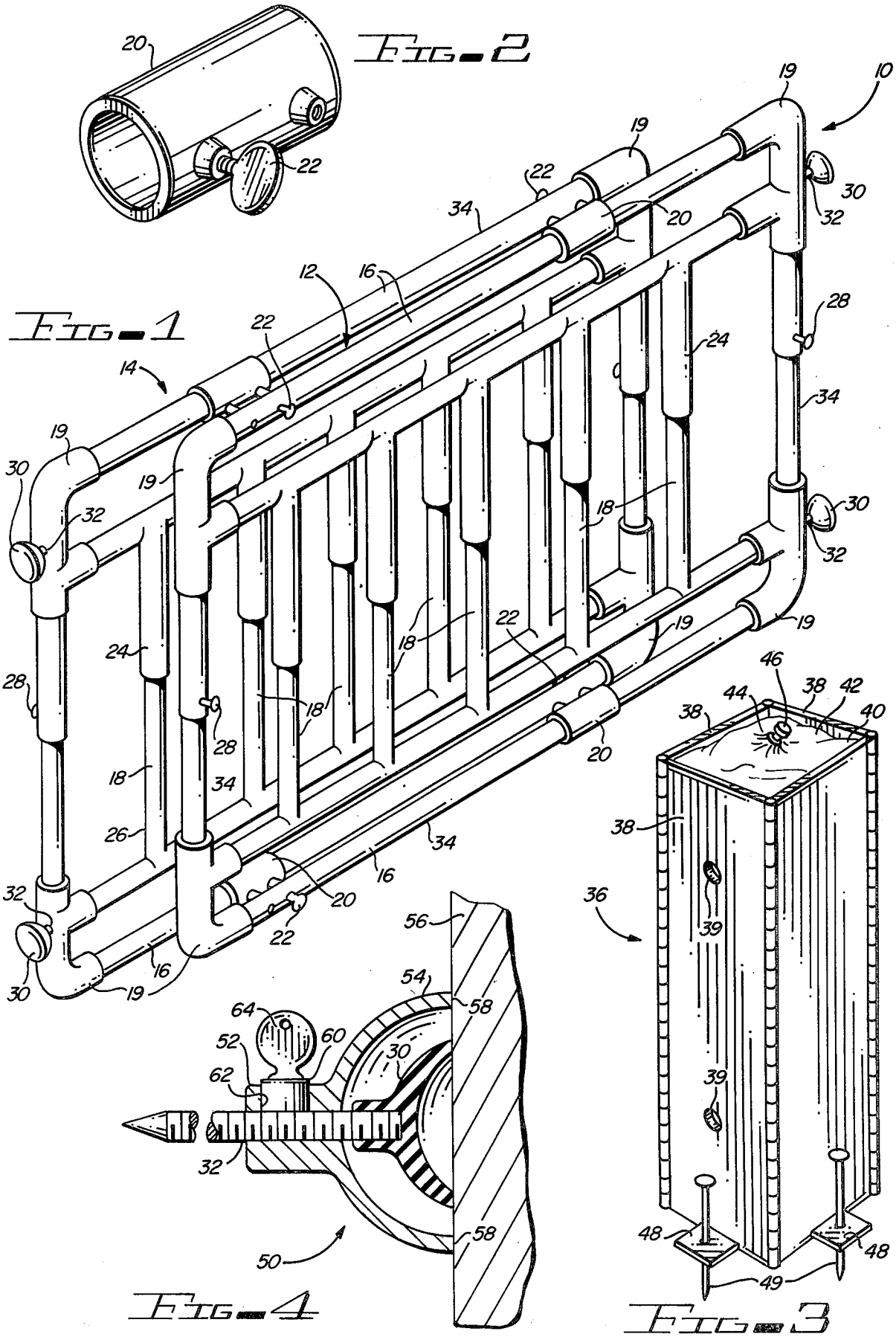
FIG. 1 is a schematic side elevation of a first preferred embodiment of the improved portable expandable barrier of the present invention.
FIG. 2 is an enlarged schematic side elevation, partly broken away, of one of the cylinders and screws utilized in the barrier of FIG. 1.
FIG. 3 is a schematic perspective view of a first preferred embodiment of a collapsible post utilizable with and forming part of the improved barrier of the present invention.
FIG. 4 is an enlarged, fragmentary schematic cross section of a suction cup of FIG. 1 connected to a structure and protected by a novel bell cover, protective device in accordance with the present invention.

FIGS. 1 and 2

Now referring more particularly to FIG. 1 of the accompanying drawings, a first preferred embodiment of the improved temporary expandable barrier of the present invention is schematically depicted therein. Thus, barrier 10 is shown in side elevation and comprises a first fence 12 and a second fence 14. Fences 12 and 14 can be fabricated of metal, such as magnesium aluminum, titanium, steel, etc., preferably of hollow tubular form, or can be of wood, plastic, cermet, ceramic, etc. Preferably, fences 12 and 14 are strong and light in weight as well as inexpensive and durable. Thus, aluminum or thin gauge steel is preferred. Fences 12 and 14 are generally rectangular and elongated similar in size and shape. Each includes spaced horizontal bars 16 spanned by and connected to spaced vertical bars 18. An "F" configured fitting 19 can be provided at the corners of fences 12 and 14 to receive and interconnect horizontal bars 16 and vertical bars 18, such fitting preferably being made of a hard, mar-resistant material such as metal. Cylinders 20 are disposed over and slide along bars 16, one cylinder 20 per bar 16. Each bar 16 has a pair of screws 22 threaded transversely therethrough, which screws 22 releasably engage the cylinder 20 of the opposite fence so that fences 12 and 14 are releasably held parallel to each other (FIG. 1) in sliding engagement. Thus, barrier 10 can be expanded and contracted lengthwise, that is, horizontally, as desired, to fill a desired space.

Each of fences 12 and 14 comprises two sections 24 and 26 telescoped together and moveable vertically relative to each other to expand or contract barrier 10 vertically (FIG. 1). Sections 24 and 26 are held in any desired telescoped position by screws 28 threadably passing through section 24 and frictionally engaging section 26, or engaging openings (not shown) in section 26.

Barrier 10 also includes means for releasably locking barrier 10 to a structure, such as a post, doorway, wall, etc. (not shown). Such means comprise a plurality of suction cups 30 disposed on threaded shanks 32 threadably received through bars 16 and 18 at spaced locations along the outer perimeter 34 of barrier 10.

When barrier 10 is to be used, its height and width are adjusted by means of cylinders 20, screws 22, sections 24 and 26 and screws 28 to fit the area to be blocked, such that cups 30 abut the structure (not shown) to which barrier 10 is to be connected. Sufficient expanding pressure is applied to barrier 10 to force cups 30 to tightly grip such structure by suction, thus firmly holding barrier 10 in place. When it is desired to remove barrier 10, the suction exerted by cups 30 is broken, screws 22 and 28 are loosened and fences 12 and 14 and sections 24 and 26 thereof, are slid toward each other so that barrier 10 can be placed in compact form and transported to storage. Thus, barrier 10 is simple to use and reuse, can be made inexpensive, durable and light in weight, is easy and compact to store and fits into a variety of spaces of different sizes and shapes.

FIG. 3

FIG. 3 schematically illustrates a collapsible post 36 which is utilizible with fences 12 and 14 as part of barrier 10. Thus, sets of fences 12 and 14 can, if desired, be connected to a plurality of spaced posts 36 in their operative upright anchored position to form a continuous self-supporting barrier not requiring attachment to any other structure. Such an arrangement could be used, for example, for outdoor crowd control or the like.

Post 36 comprises four upstanding elongated sidewalls or plates 38 of metal, plastic, wood, etc. hinged together to define a central vertical space 40 within which is disposed an expandable bladder 42, preferably of rubber or other elastomer. When water or other fluid is introduced into bladder 42 through neck 44 thereof to fill bladder 42 and is retained therein by neck stopper 46, post 36 is moved into the fully opened operative position shown in FIG. 3. Openings 39 can be provided in plates 38 to receive pins 76 of the barrier shown in FIG. 6 (hereafter described). The bottom extension 48 depend from and extend at right anles to pleates 36 and are adapted to have spikes 49 passed therethrough to anchor post 36 firmly into the ground in the upright position so that post 36 forms, when connected to one of the fences 12 and 14 via suction cups 30, an effective self-supporting barricade; as described above. When it is desired to store post 36, stopper 46 is temporarily removed and bladder 42 is allowed to fully deflate, so that plates 38 can collapse on one another to minimize the stored volume of post 36. Post 36 is thus simple, inexpensive, portable and effective, and when filled with water, heavy and rigid.

FIG. 4

Cups 30 can be protected against tampering, release of suction from cup 30 and subsequent disassembly of barrier 10 when erected through the use of the protective lockable bell cover 50 shown schematically in FIG. 4. Bell cover 50 of metal, plastic, wood or the like has an internally threaded shank 52 through which shank 32 is threadably received so that the main body 54 of cover 50 can be disposed over and spaced from suction cup 30, as shown in FIG. 4. Cover 50 is normally used by having it on shank 32 rearward of the front end of cup 30. When cup 30 has been pressed against structure 56 that cups 30 adheres to it firmly by suction, cover 50 is then turned until its front end 58 tightly abuts structure 56 (FIG. 4). A key lock cylinder 60 is provided and is turned at transverse opening 62 in shank 52 until it tightly abuts shank 52 (FIG. 4) and locks cover 50 firmly in place, after which key 64 is withdrawn. Full protection of cup 30 is thus afforded. Cover 50 can be effectively used in barrier 10 in the described manner.

FIG. 5

Figure 5:
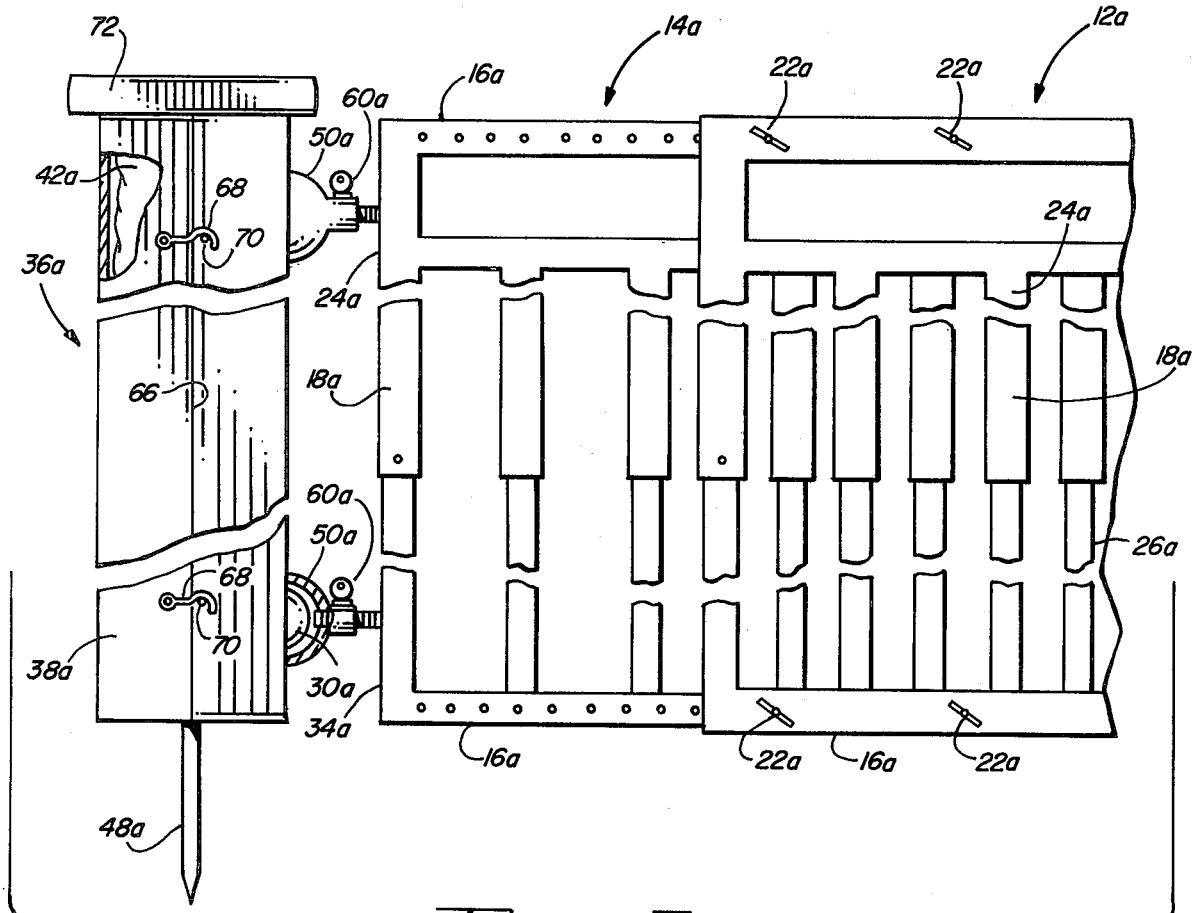
FIG. 5 is a fragmentary schematic side elevation of a second preferred embodiment of the improved barrier of the present invention; and, FIG. 6 is a fragmentary, schematic side elevation, partly broken away, of a third preferred embodiment of the improved barrier of the present invention, showing the barrier installed in a window frame.

A second preferred embodiment of the improved portable barrier of the present invention is schematically depicted in FIG. 5. Thus, barrier **10*a* is shown. Components thereof similar to those of barrier 10, post 36 and cover 50 bear the same numerals but are succeeded by the letter "a". Barrier 10*a* includes overlapping fences 12*a* and 14*a* which have horizontal bars 16*a* and vertical bars 18*a*. Screws 22*a* are threaded transversely into adjacent bars 16*a* of both fences 12*a* and 14*a* to hold them together in a desired orientation. Each of fences 12*a* and 14*a* comprises telescoping sections 24*a* and 26*a* releasably secured together by screws 28*a***.

Suction cups **30*a* are secured by threaded shanks 32*a* to perimeter 34*a* of fences 12*a* and 14*a*. Protective bell covers 50*a* bearing key lock cylinders 60*a* are disposed over cups 30*a***.

Cups **30*a* releasably and firmly adhere by suction to the outer surface of plate 38*a* of post 36*a* which bears inflated bladder 42*a* therein and depending spike(s) 48*a*. Only a single plate 38*a* of collapsible yet strong material is used for post 36*a*, the opposite ends 66 thereof being secured together by hooks 68 and pins 70. A flat removable top 72 provides an adequate strike surface for driving spike 48*a*** into the ground.

Post **36*a* and fences 12*a* and 14*a* can be easily assembled into barrier 10*a* and as easily disassembled and stored. Post 36*a* can be collapsed by deflating bladder 42*a*, after removal of top 72, and disengaging hooks 68 and pins 70. A plurality of posts 36*a*, and fences 12*a* and 14*a* can be provided with a post 36*a* disposed on each side of each set of fences 12*a* and 14*a* along the length of rapidly deployable barrier 10*a*. Barrier 10*a* has the advantages of barrier 10 and can be used with or without posts 36*a***.

FIGURE 6

Figure 6:
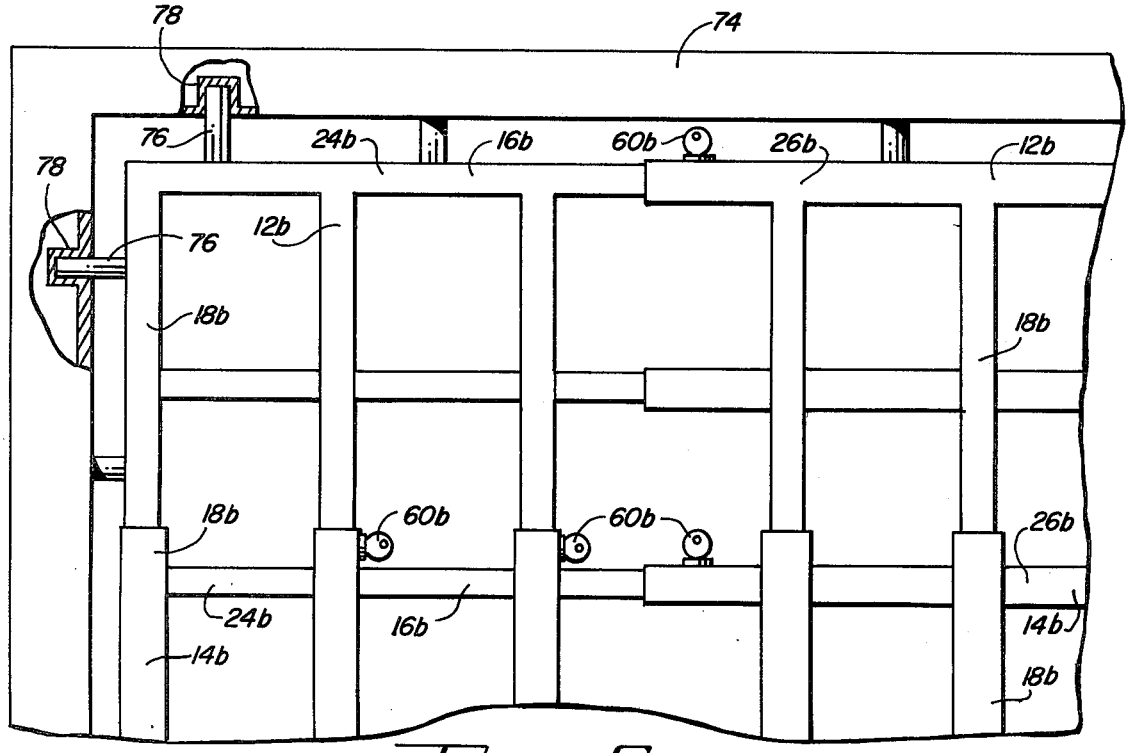

A third preferred embodiment of the improved portable barrier of the present invention is schematically depicted in FIG. 6. Thus, barrier **10*b* is shown. Components thereof similar to those of barrier 10 bear the same numerals but are succeeded by the letter "b". Barrier 10*b* is shown disposed within and releasably secured to a window frame 74. Barrier 10*b* comprises two fences 12*b* and 14*b* which do not merely overlap each other, but instead are telescoped on each other. Each of fences 12*b* and 14*b* includes horizontal bars 16*b* and vertical bars 18*b*. However, bars 18*b* of lower fence 14*b* telescopingly receive the lower ends of bars 16*b* of upper fence 12*b*, and are releasably locked into place therewith by certain ones of key lock cylinders 60*b* extending through lower bars 16*b*, as shown in FIG. 6. Each of fences 12*b* and 14*b* is divided into two sections 24*b* and 26*b* which telescope together horizontally through bars 16*b* and are locked together by other ones of key lock cylinder 60*b* extending therethrough (FIG. 6). Thus, barrier 10*b* is adjustable in width and height to fit the space defined by frame 74**.

In order to prevent barrier **10*b* from being lifted or pushed out of frame 74, perimeter 34*b* of barrier 10*b* bears a plurality of cylindrical pins 76 secured thereto and projecting outwardly thereof for reception within mating cylindrical apertures 78 in frame 74. It will be understood that pins 76 and apertures 78 need only be provided on two opposite or adjoining sides of frame 74 preferably two opposite sides, in order to lock barrier 10*b* firmly in place in frame 74; once cylinders 60*b*** are locked. Thus, an effective burglar proof grill is provided which is simple to install, remove and store. Other advantages of the improved portable barrier of the present invention are as set forth in the foregoing.

Various modifications, changes, alterations and additions can be made in the improved portable barrier of the present invention, its components and their parameters. All such changes, modifications, alterations and additions as are within the scope of the appended claims form part of the present invention.

What is claimed is:

1. An improved portable expandable barrier, said barrier comprising, in combination:
(a) a first fence;
(b) a second fence interconnected to said first fence for sliding movement relative thereto to expand and contract said barrier,
(c) first locking means secured to said first and second fences to releasably lock said fences together; and,
(d) second locking means secured to said first and second fences to releasably lock said fences to a structure,
(e) wherein said fences include elongated bars and said locking means comprise cylinders slideably disposed over said bars and pins extending through said bars, said pins of each of said fences engaged with said sliding cylinders of the other of said fences.

2. The improved barrier of claim 1 wherein said barrier includes at least one collapsible portable post, said post comprising elongated upstanding side walls moveable between an operative upright position defining a central space and an about collapsed position, an inflatable bladder disposed within said space, and capable of effecting said movement and securing means connected to the lower end of said post for holding said post in an upright position secured to the ground.

3. The improved barrier of claim 2 wherein said sidewalls are flat plates hinged together, wherein said securing means comprises a spike and wherein said first locking means comprises a plurality of screws threadably releasably interconnecting said fences.

4. An improved portable expandable barrier, said barrier comprising, in combination:
(a) a first fence;
(b) a second fence interconnected to said first fence for sliding movement relative thereto to expand and contract said barrier;
(c) first locking means secured to said first and second fences to releasably lock said fences together; and,
(d) second locking means secured to said first and second fences to releasably lock said fence to a structure,
(1) said second locking means comprising suction cups connected to, spaced along and extending outwardly from the perimeter of said fences, and
(2) wherein said second locking means include bell covers adjustably threaded to and releasably locked over said suction cups to prevent tampering with said suction cups.

5. An improved portable expandable barrier, said barrier comprising, in combination:
(a) a first fence;
(b) a second fence interconnected to said first fence for sliding movement relative thereto to expand and contract said barrier,
(c) first locking means secured to said first and second fences to releasably lock said fences together; and,
(d) second locking means secured to said first and second fences to releasably lock said fences to a structure,
(e) wherein each of said first and second fences comprises two sections slideably interconnected in telescoping relation and wherein said two fences are telescoped together,
(f) wherein said first locking means comprise lock set cylinders releasably locking said sections and fences together,
(g) wherein a barrier is adapted to be secured to a frame, and wherein said second locking means, comprise pins secured to, spaced along and projecting outwardly from the perimeter of said fences for releasable reception in openings in a frame.

* * * * *